US007775223B2

(12) United States Patent
Gunnerson et al.

(10) Patent No.: US 7,775,223 B2
(45) Date of Patent: Aug. 17, 2010

(54) FLEXIBLE UTILITY LINK FOR A DRAWER-TYPE DISHWASHER

(75) Inventors: Kory A. Gunnerson, West Lafayette, IN (US); Heather Hagans, Jackson, TN (US); Kristen K. Hedstrom, Orlando, FL (US); Mark E. Palm, Orlando, FL (US); Rodney M. Welch, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 859 days.

(21) Appl. No.: 11/288,373

(22) Filed: Nov. 29, 2005

(65) Prior Publication Data

US 2007/0119483 A1 May 31, 2007

(51) Int. Cl.
*B08B 3/00* (2006.01)

(52) U.S. Cl. ..... 134/186; 134/200; 312/228.1; 174/69

(58) Field of Classification Search ..... 134/200, 134/186, 56 D, 58 D; 312/228.1, 228; 174/69, 174/650–669
See application file for complete search history.

(56) References Cited

U.S. PATENT DOCUMENTS

| | | | | |
|---|---|---|---|---|
| 2,661,750 | A | 12/1953 | McNairy | |
| 2,668,091 | A | 2/1954 | Clark | |
| 4,179,307 | A | 12/1979 | Cau et al. | |
| 4,790,205 | A * | 12/1988 | Stocker | 74/500.5 |
| 5,743,281 | A | 4/1998 | Sargeant et al. | |
| 5,755,244 | A * | 5/1998 | Sargeant et al. | 134/46 |
| 5,987,935 | A * | 11/1999 | Uhlin | 68/207 |
| 6,189,551 | B1 | 2/2001 | Sargeant et al. | |
| 6,244,277 | B1 | 6/2001 | Maunsell | |
| 6,260,565 | B1 | 7/2001 | Welch et al. | |
| 6,327,139 | B1 * | 12/2001 | Champion et al. | 361/608 |
| 6,460,555 | B1 | 10/2002 | Tuller et al. | |
| 6,491,049 | B1 | 12/2002 | Tuller et al. | |
| 6,571,808 | B2 | 6/2003 | Todd | |

(Continued)

FOREIGN PATENT DOCUMENTS

EP 0 807 400 A2 11/1997

(Continued)

OTHER PUBLICATIONS

Machine Translation: JP 2005-110733, Hara et al. Apr. 2005.*

(Continued)

*Primary Examiner*—Michael Kornakov
*Assistant Examiner*—Naomi Birbach
(74) *Attorney, Agent, or Firm*—John W. Morrison; Diederiks & Whitelaw PLC

(57) ABSTRACT

A drawer-type dishwasher includes a outer housing and an extensible wash chamber that in a first position resides completely within the outer housing and in a second position extends completely out from the outer housing. The wash chamber is connected to the outer housing through a utility link. In order to permit full travel of the wash chamber, the utility link is provided with multiple, flexible loops. The utility link can include a drain hose, an electrical cable or a combination of both. Regardless, the utility link is supported through a carrier that is connected at one end to the outer housing and at another end to the wash chamber.

16 Claims, 4 Drawing Sheets

U.S. PATENT DOCUMENTS

| | | | |
|---|---|---|---|
| 2004/0085005 | A1 | 5/2004 | Nakano et al. |
| 2004/0085006 | A1 | 5/2004 | Shinchi et al. |

FOREIGN PATENT DOCUMENTS

| | | | | |
|---|---|---|---|---|
| JP | 3129311 | | * | 11/2000 |
| JP | 2001000377 | A | | 1/2001 |
| JP | 2003180465 | | | 12/2001 |
| JP | 2002315714 | | | 10/2002 |
| JP | 2005-110733 | | * | 4/2005 |

OTHER PUBLICATIONS

Machine Translation: JP 3129311, Naito. Nov. 2000.*

* cited by examiner

FLEXIBLE UTILITY LINK FOR A DRAWER-TYPE DISHWASHER

BACKGROUND OF THE INVENTION

1. Field of the Invention

The present invention pertains to the art of dishwashers and, more particularly, to a utility link that interconnects a washing chamber to a outer housing of a drawer-type dishwasher.

2. Discussion of the Prior Art

In general, dishwashers having pull-out drawers supported in cabinets are known in the art. The dishwasher may include a single, pull-out drawer or wash tub or, in some cases, the dishwasher will include an upper, pull-out drawer forming a first wash tub for washing dishware and a lower pull-out drawer forming a second wash tub that can be selectively operated to supplement the first wash tub. In any event, known drawer-type wash tubs are mounted on extensible rails that are carried by a surrounding cabinet. Typically, the cabinet is positioned under a kitchen countertop, adjacent to cabinetry or other kitchen appliances.

In order to allow the wash tub to be withdrawn from the cabinet, any utility connections, such as water or electrical lines, between the wash tub and the cabinet must either be flexible or sufficiently long to facilitate the loading and unloading of dishware. Simply making the lines long enough to provide sufficient length to withdraw the wash chamber has also not proven effective. Long lines and hoses often become tangled or snagged on the interior structure of the cabinet. In addition, a flexible line cannot be so large as to droop, as the line can interfere or snag on internal structure of the appliance. Over time, repeated snags will create a risk of tearing or cracking the lines/hoses and breaking the connections.

Still, in order to increase the overall utility of drawer-type dishwashers, the extensible wash tub must be able to extend out completely from the cabinet. For instance, loading and unloading of large kitchenware, such as mixing bowls, baking pans and the like, can be very difficult if access to the wash tub is limited. Therefore, there exists a need for a utility connection that permits full extension of a wash tub of a drawer-type dishwasher. More specifically, there exists a need for a utility connection that allows full extension of the wash tub, while assuring that the utility connection does not snag on or interfere with other structure of the dishwasher.

SUMMARY OF THE INVENTION

The present invention is directed to a drawer-type dishwasher including an outer housing or frame provided with at least rear and opposing side walls, a drawer including front, rear, bottom and opposing side walls that collectively define a wash chamber or tub, and a lid for selectively closing the wash chamber. The wash tub is shiftable between a first position wherein the wash chamber resides totally within the frame and a second position wherein the wash chamber extends from the frame to facilitate the loading and unloading of dishware. In a similar manner, the lid is shiftable between a first position wherein the lid covers the wash chamber when the wash chamber is in the outer housing and a second position wherein the lid is raised above the wash chamber when the wash chamber is withdrawn from the outer housing.

In accordance with the invention, the wash chamber is connected to utilities, such as a household drain and/or electricity through at least one utility link. The utility link is formed with multiple, flexible loops that enable the wash chamber to shift between the first and second positions while, at the same time, maintaining a connection to the utilities. In accordance with one embodiment, the utility link is constituted by a drain hose. In another embodiment, the utility link is constituted by an electrical cable. In a still further embodiment, both the drain hose and electrical cable are combined. Regardless of the particular embodiment, the utility link is supported by a carrier. The carrier is preferably constituted by a flexible, yet partially rigid support structure that is connected at one end to the frame or outer housing and at another end to the wash chamber. The carrier supports the utility link as the wash chamber is shifted into and out of the frame, thereby assuring that the utility link will not snag the frame or otherwise interfere with a full range of movement of the wash chamber.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
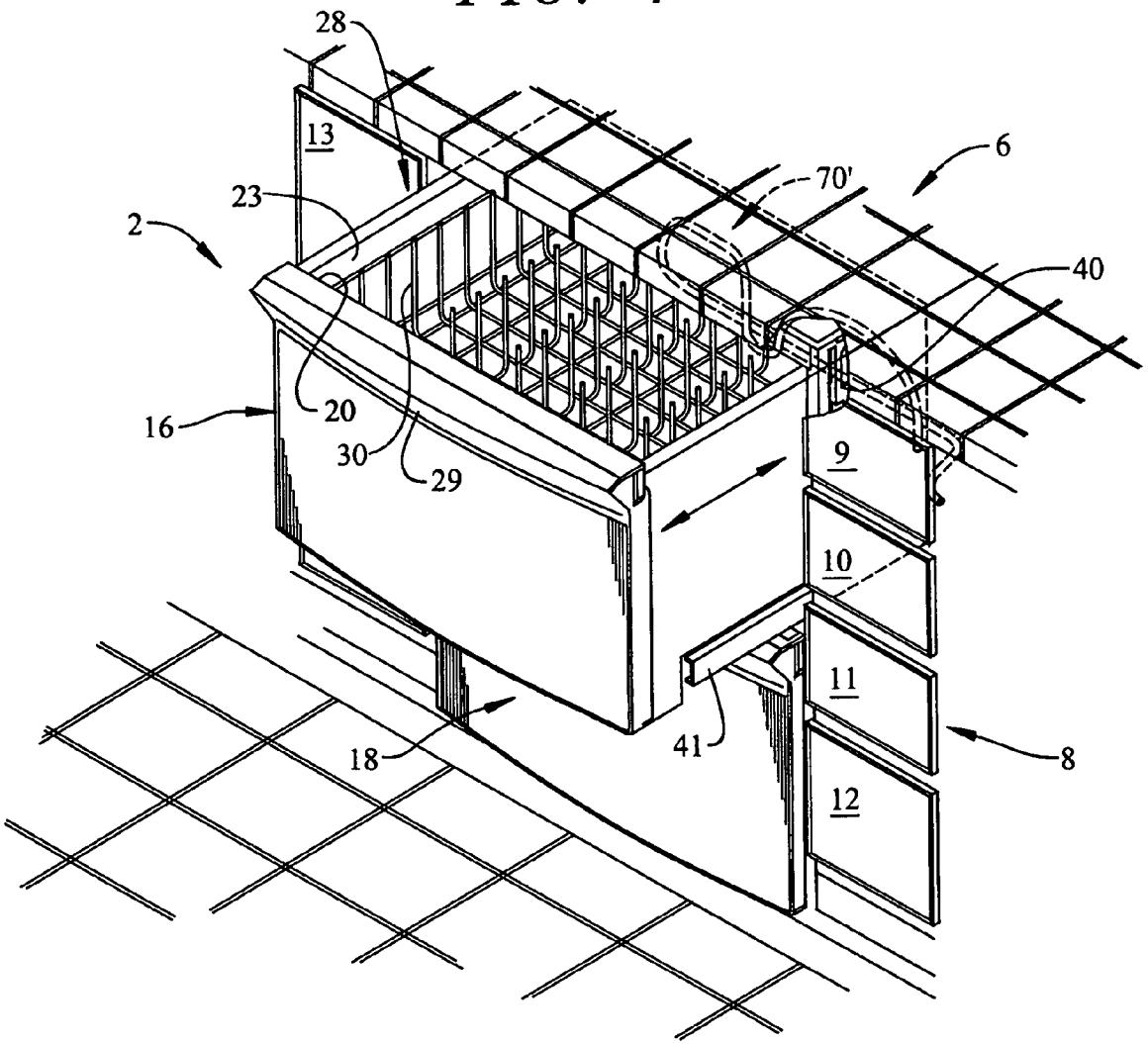
FIG. 1 is an upper right perspective view of a drawer-type dishwasher including upper and lower drawers provided with a utility link constructed in accordance with the present invention, with the dishwasher being positioned below a kitchen countertop.
Figure 2:
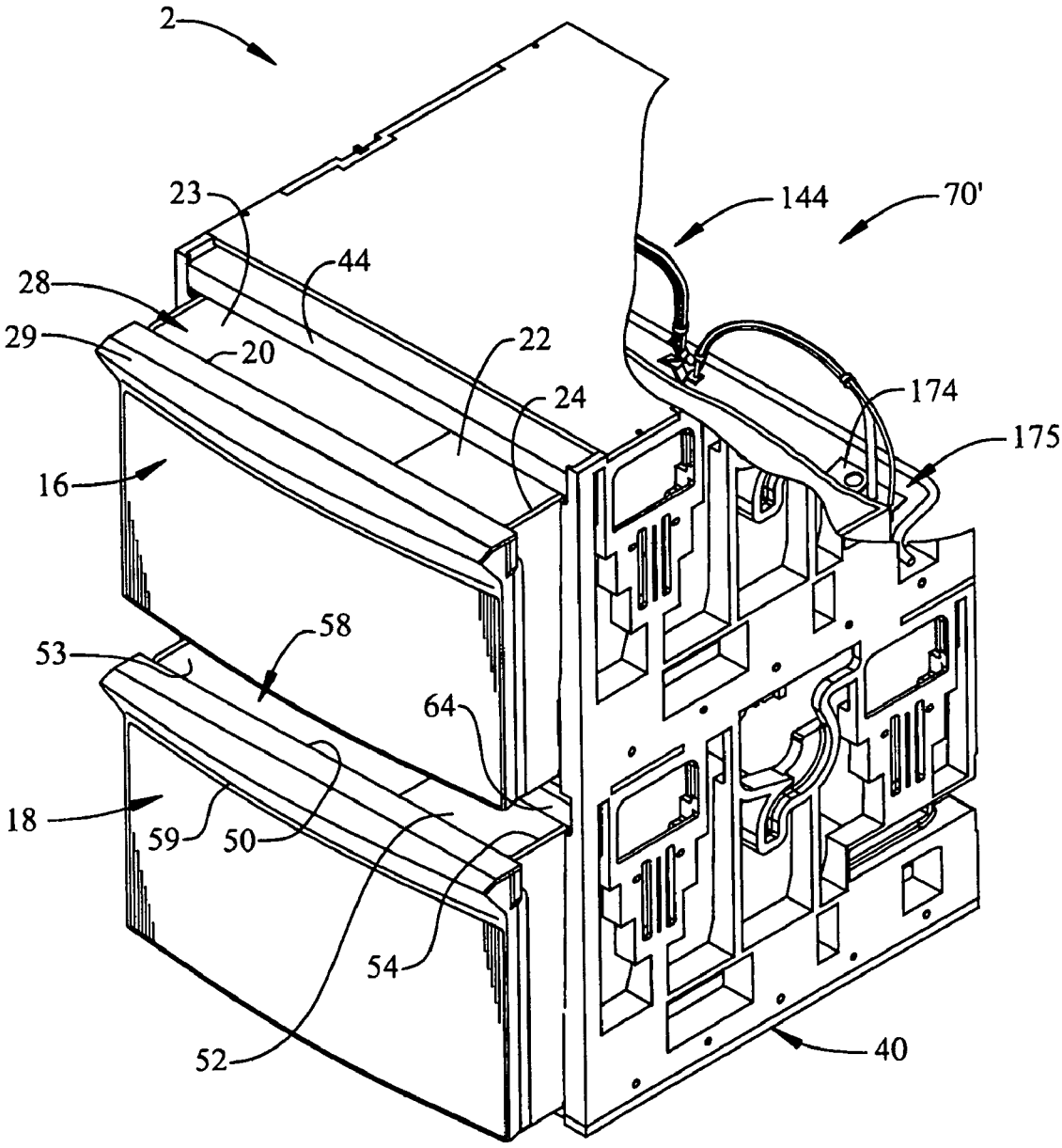
FIG. 2 is a partial cut-away upper-right perspective view of the dishwasher of FIG. 1 removed from below the kitchen countertop, thereby exposing the utility link constructed in accordance with a first embodiment of the present invention.
Figure 3:
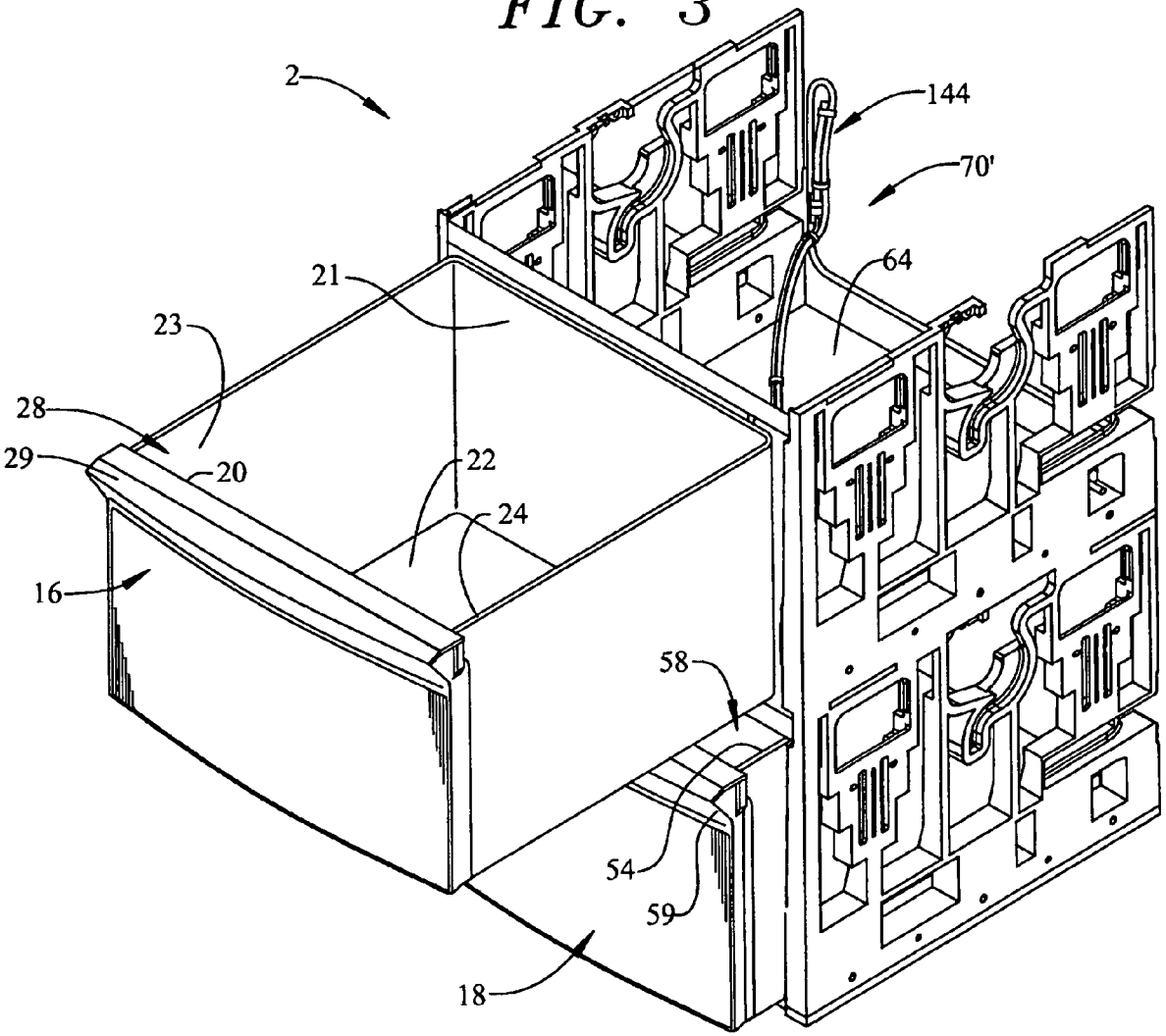
FIG. 3 is a partial cut-away view of the dishwasher of FIG. 2, shown with the upper drawer in an extended position.

With initial reference to FIGS. 1-3, a dishwasher constructed in accordance with the present invention is generally indicated at 2. As shown, dishwasher 2 is arranged below a kitchen countertop 6. Also below kitchen countertop 6 is shown cabinetry 8 including a plurality of drawers 9-12, as well as a cabinet door 13. Although the actual dishwasher into which the present invention may be incorporated can vary, the invention is shown in connection with dishwasher 2 depicted as a dual cavity dishwasher 2 having an upper basin or drawer 16 and a lower basin or drawer 18.

In accordance with the embodiment shown, upper drawer 16 includes a front wall 20, a rear wall 21, a bottom wall 22 and opposing side walls 23 and 24 that collectively define an upper wash chamber or tub 28. In a manner known in the art, upper drawer 16 is provided with a handle 29 for accessing an interior of tub 28. In a manner also known in the art, tub 28 includes a dish rack 30 for supporting various objects, such as glassware, utensils and the like, to be exposed to a washing operation. Upper drawer 16 is slidably mounted within a frame 40 through a pair of extendible drawer support glides or rails, one of which is indicated at 41. The details of frame 40 do not constitute part of the present invention and therefore will not be discussed further here other than to note that frame 40 preferably constitutes an open latticework.

In addition, upper drawer 16 is provided with a vertically shiftable lid member 44 that is adapted to selectively seal against an upper portion (not separately labeled) of tub 28. That is, when upper drawer 16 is inserted into frame 40, lid member 44 is lowered to seal about tub 28 and, when drawer 16 is withdrawn from frame 40, lid member 44 is caused to be raised so as to enable drawer 16 to be withdrawn from frame 40 and provide access to tub 28. As the particular manner in which lid member 44 is raised or lowered is not part of the present invention, this aspect of dishwasher 2 will not be detailed further here.

In a similar manner, lower drawer 18 includes a front wall 50, a rear wall (not shown), a bottom wall 52 and opposing side walls 53 and 54 that collectively define a lower wash chamber or tub 58. Lower drawer 18 is provided with a handle 59 that enables a consumer to readily access tub 58, with lower drawer 18 being slidably mounted within frame 40 through a pair of extensible drawer glides or rails (not shown). In addition, lower drawer 18 is provided with a shiftable lid member 64 which lowers to selectively seal lower drawer 18 when lower drawer 18 is inserted into frame 40, and is raised when lower drawer 18 is to be withdrawn from frame 40.

Each drawer 16 and 18 includes an associated pump system (not shown) that delivers washing fluid to wash arms supported in wash chambers 28 and 58. Actually, the pump systems create a recirculating flow of washing fluid that is directed upon dishware and the like arranged in tub 28 and/or 58 during a washing operation. The entire pump and filtration system is not part of the present invention and therefore will not be discussed further. However, additional details of the pump and filtration system can be found in commonly assigned U.S. patent application Ser. No. 10/785,027, entitled "Dishwasher Pump and Filtration System" filed on Feb. 25, 2004 which is incorporated herein by reference. In general, the above description is provided for the sake of completeness as the present invention is particularly directed to a utility link 70 that connects, for example, wash chamber or tub 28 with a household drain line and/or electrical mains.

Figure 4:
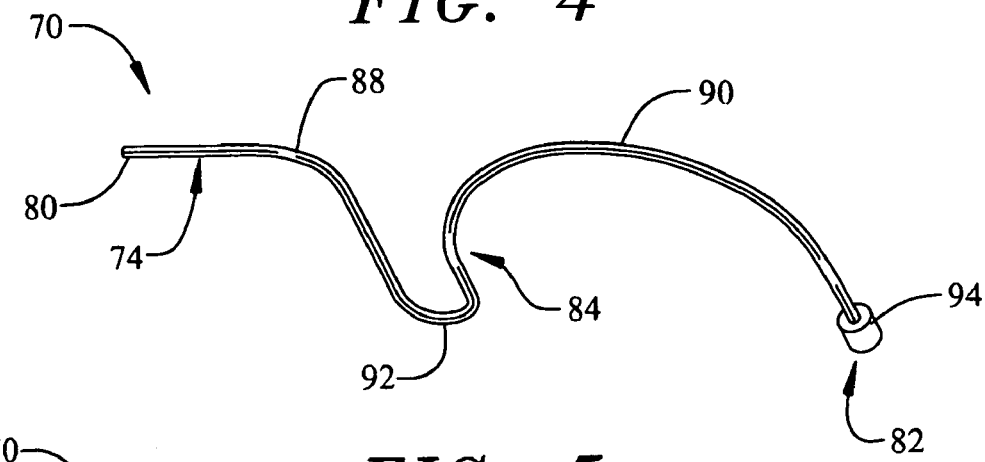
FIG. 4 is a perspective view of the utility link constructed in accordance with a first embodiment of the invention.

In accordance with one aspect of the present invention illustrated in FIG. 4, utility link 70 is constituted by an electrical cable 74 having a first end 80 that extends to a second end 82 through an intermediate portion 84. In accordance with a preferred form of the invention, intermediate portion 84 includes a first flexible loop section 88 and a second flexible loop section 90 that are joined through a trough section 92. First and second flexible loop sections 88 and 90 enable, for example, drawer 16 to be fully withdrawn from frame 40. That is, as drawer 16 is withdrawn from frame 40, first and second flexible loop portions 88 and 90 begin to straighten. As flexible loop portions 88 and 90 straighten, utility link 70 allows drawer 16 to extend from frame 40 to facilitate loading and unloading of dishware while, at the same time, maintaining a viable utility connection. Electrical cable 74 is also shown to include a connector member 94 provided at second end 82. As will also be discussed more fully below, connector 94 is adapted to interconnect with and provide electrical power to the pump system (not shown) for a respective tub 28, 58.

Figure 5:
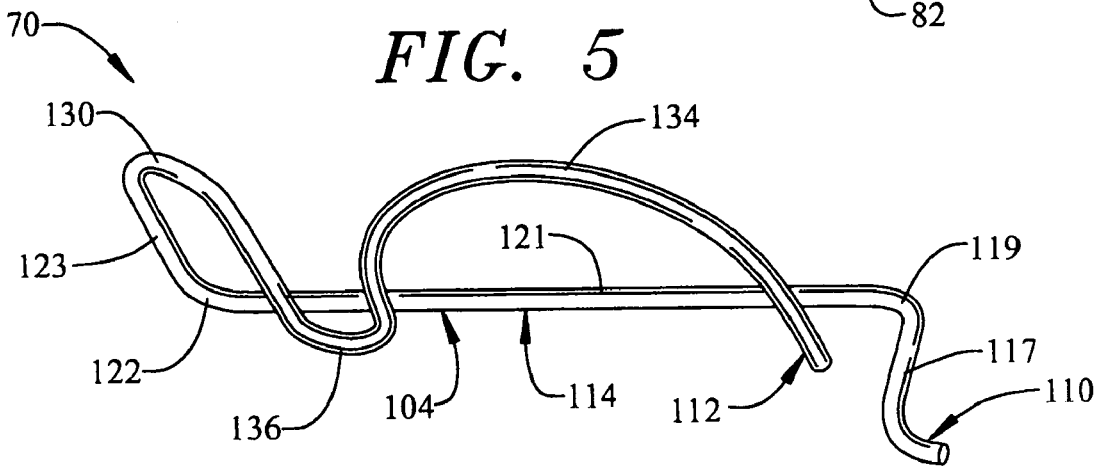
FIG. 5 is a perspective view of the utility link constructed in accordance with a second embodiment of the invention.

In accordance with another embodiment of the present invention as shown in FIG. 5, a utility link 70' is constituted by a drain hose 104. Drain hose 104 includes a first end 110 adapted to extend through frame 40 and connect to a household drain. First end 110 leads to a second end 112 through an intermediate portion 114. In further accordance with the invention, intermediate portion 114 includes a first section 117 which leads to a first curved portion 119. Leading from first curved portion 119 is a second substantially straight section 121 which terminates in a second curved portion 122. At this point, second curved portion 122 leads to a third, substantially straight section 123 which terminates at a first flexible loop section 130. Drain hose 104 is also provided with a second flexible loop section 134 which is joined to first flexible loop section 130 through a trough section 136. In a manner similar to that described above with respect to utility link 70, first and second flexible loop sections 130 and 134, as well as trough section 136, enable drawer 16 to be fully withdrawn from outer housing 70.

Figure 6:
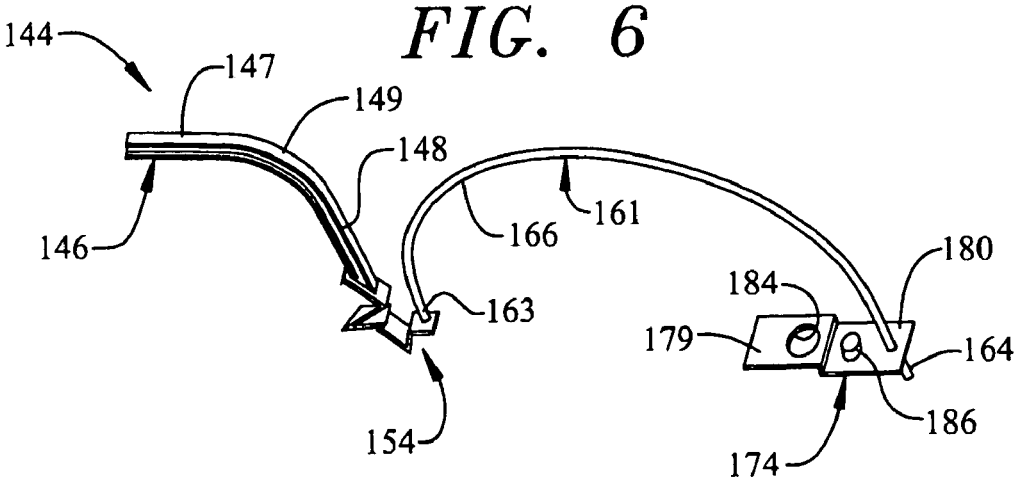
FIG. 6 is a perspective view of a utility link carrier constructed in accordance with the present invention.

As best shown in FIG. 6, utility link 70 and/or 70' is supported by a utility link carrier 144. Utility link carrier 144 provides support for first and second flexible loops 88 and 90 of cable 74 and/or first and second flexible loops 130 and 134 of drain hose 104. That is, utility link carrier 144 is designed to support electrical cable 74 or drain hose 104 individually, or both electrical cable 74 and drain hose 104 together. In the embodiment shown in FIG. 6, utility link carrier 144 includes a first, substantially rigid portion 146 which is mounted to or supported by frame 40. As shown, first portion 146 includes a first end 147 that leads to a second end 148 through an intermediate portion 149 which, in the embodiment shown, is curvilinear in shape. Provided at second end 148 is a flexible joint 154, formed from plastic spring steel or the like, which serves to interconnect first portion 146 with a semi-rigid support 161. Semi-rigid support 161 is formed from a resilient or elastomeric material that allows utility link carrier 144 to move with utility link 70 and/or 70' yet return to a bowed or curvilinear shape to provide support for flexible loop section 90 and/or 134.

In accordance with the invention, semi-rigid support 161 includes a first end 163 fixedly secured to flexible joint 154 and extending to a second end 164 through an intermediate or support section 166. Intermediate or support section 166 is secured to second loop section 90 and/or 134 of electrical cable 74 and drain hose 104 through the use of, for example, cable ties, clamps or the like. In this manner, when drawer 16 is in a retracted position as shown in FIG. 2, utility link 70, 70' is not caused to sag or fall into other portions of dishwasher 2 creating a snag hazard. When drawer 16 is withdrawn from frame 40, utility link carrier 144 fully supports utility link 70, 70' while allowing loops 90 and/or 134 to extend. As described above, utility link carrier 144 is formed from resilient or elastomeric material so that, when drawer 16 is shifted between open and closed positions, utility link carrier 144 moves with drawer 16 and, most importantly, returns to an original, at rest state. More specifically, as drawer 16 shifts out from frame 40, semi-rigid support 161 shifts with drawer 16. Once drawer 16 nears a fully open position, flexible joint 154 stretches as a strain relief, while rigid portion 146 remains fixed relative to frame 40.

Also shown in FIG. 6, second end 164 is provided with a mounting flange 174 that is adapted to interconnect with electrical cable 74 and/or drain hose 104. Mounting flange 174 is fixedly secured to a rear portion of drawer 16 adjacent a utility connection point 175. In order to properly receive electrical cable 74 and/or drain hose 104, mounting flange 174 is provided with first and second plate portions 179 and 180 which, in the embodiment shown, are off-set one from the other. First plate portion 179 is provided with a cable receiving section or opening 184 adapted to receive connector member 94 of electrical cable 74. In this manner, electrical cable 74 can be supported and the connection to drawer 16 maintained while avoiding undo stress on the connection. In a similar manner, second plate 180 is provided with a drain hose receiving tubular section 186. Drain hose receiving tubular section 186 interconnects second end 112 of a drain hose 104 to a hose receiving portion of a drain pump (not shown) carried by drawer 16.

Based on the above, it should be readily understood that the utility link 70 of the present invention provides a viable and flexible connection between a wash chamber of a drawer-type dishwasher and household utilities, for example, electrical and drain connections. Furthermore, utility link 70, 70' and utility link carrier 144 enable drawer 16 of the wash chamber to be fully withdrawn from frame 40 such that rear wall 21 can extend well beyond countertop 6 so as to enable a consumer to easily insert large kitchenware, such as baking pans and the like, while still maintaining the necessary utility connections.

Although described with reference to preferred embodiments of the invention, it should be readily understood that various changes and/or modifications can be made to the invention without departing from the spirit thereof. For instance, while described in connection with upper drawer 16, a corresponding utility link arrangement is also employed in connection with lower drawer 18. In general, the invention is only intended to be limited by the scope of the following claims.

We claim:

1. A dishwasher comprising:

an outer housing;

a drawer including front, rear, bottom and opposing side walls that collectively define a wash chamber, said drawer being shiftable between a first position wherein the wash chamber is received by the outer housing and a second position wherein the wash chamber is fully extended out of the outer housing;

a utility link interconnected between the wash chamber and the outer housing, said utility link including, formed therein, multiple, flexible loops when the utility link is in a relaxed, non-extended state, wherein each of the multiple, flexible loops straighten to enable the drawer to shift between the first and second positions while, at the same time, remaining connected to the outer housing; and a utility link carrier for supporting at least one of the multiple flexible loops of the utility link, the utility link carrier including a rigid portion fixed relative to the outer housing and a semi-rigid support having a first end secured to the rigid portion.

2. The dishwasher according to claim 1, wherein the multiple, flexible loops constitute two flexible loops extending between the outer housing and the wash chamber.

3. The dishwasher according to claim 1, wherein the utility link constitutes at least one of an electrical cable and a drain line.

4. The dishwasher according to claim 1, wherein the utility link includes a first end adapted to connect to the drawer and a second end adapted to connect to a utility.

5. The dishwasher according to claim 4, wherein the utility link carrier further comprises a first end connected to the drawer and a second end supported by the outer housing.

6. The dishwasher according to claim 5, wherein the utility link is connected to the semi-rigid support.

7. The dishwasher according to claim 6, wherein at least one of the multiple flexible loops of the utility link is secured to the semi-rigid support.

8. The dishwasher according to claim 6, further comprising: a flexible joint joining the first end of the semi-rigid support to the rigid portion.

9. The dishwasher according to claim 6, further comprising: a mounting flange attached to the first end of the utility link carrier, said mounting flange receiving the first end of the utility link, wherein the first end of the utility link is connected to the drawer by the mounting flange.

10. The dishwasher according to claim 9, wherein the mounting flange includes a drain hose receiving section and an electrical cable receiving section, said drain hose receiving section being adapted to secure a drain line relative to the drawer and said electrical cable receiving section being adapted to anchor an electrical cable relative to the drawer.

11. A dishwasher comprising:

an outer housing;

a drawer including front, rear, bottom and opposing side walls that collectively define a wash chamber, said drawer being shiftable between a first position wherein the wash chamber is received by the outer housing and a second position wherein the wash chamber is fully extended out of the outer housing;

a utility link, constituting at least one of an electrical cable and a wash liquid drain line, interconnected between the wash chamber and the outer housing, said utility link including at least one flexible loop formed therein; and a utility link carrier including at least one flexible loop formed therein for supporting the at least one flexible loop of the utility link, said utility link carrier having a first end connected to the drawer and a second end supported by the outer housing, wherein both the flexible loop and a portion of the utility link carrier straighten to enable the drawer to shift between the first and second positions while, at the same time, maintaining a connection of the utility link to the drawer, wherein the utility link carrier includes a substantially rigid portion fixed relative to the outer housing and a resilient, semi-rigid support having a first end secured to the rigid portion, said utility link being connected to the semi-rigid support.

12. The dishwasher according to claim 11, wherein the utility link includes multiple, flexible loops extending between the outer housing and the wash chamber.

13. The dishwasher according to claim 11, wherein the at least one flexible loop of the utility link is secured to the semi-rigid support.

14. The dishwasher according to claim 13, further comprising: a flexible joint joining the first end of the semi-rigid support to the rigid portion.

15. The dishwasher according to claim 14, further comprising: a mounting flange attached to the first end of the utility link carrier, said mounting flange receiving an end of the utility link.

16. The dishwasher according to claim 15, wherein the mounting flange includes a drain hose receiving section and an electrical cable receiving section, said drain hose receiving section being adapted to secure a drain line relative to the drawer and said electrical cable receiving section being adapted to anchor an electrical cable relative to the drawer.

* * * * *